US009613789B1

(12) United States Patent
Desai et al.

(10) Patent No.: US 9,613,789 B1
(45) Date of Patent: Apr. 4, 2017

(54) COMPACT DUAL ION COMPOSITION INSTRUMENT

(71) Applicant: Southwest Research Institute, San Antonio, TX (US)

(72) Inventors: Mihir I. Desai, Helotes, TX (US); Keiichi Ogasawara, San Antonio, TX (US); David J. McComas, San Antonio, TX (US); Stefano Livi, San Antonio, TX (US)

(73) Assignee: SOUTHWEST RESEARCH INSTITUTE, San Antonio, TX (US)

( * ) Notice: Subject to any disclaimer, the term of this patent is extended or adjusted under 35 U.S.C. 154(b) by 0 days.

(21) Appl. No.: 15/005,662

(22) Filed: Jan. 25, 2016

(51) Int. Cl.
*H01J 49/40* (2006.01)
*H01J 49/22* (2006.01)
*H01J 49/04* (2006.01)

(52) U.S. Cl.
CPC ..... *H01J 49/40* (2013.01); *H01J 49/04* (2013.01); *H01J 49/22* (2013.01)

(58) Field of Classification Search
CPC ..... H01J 49/04; H01J 49/22; H01J 49/40
USPC ..... 250/283
See application file for complete search history.

(56) References Cited

U.S. PATENT DOCUMENTS 7,217,918 B1 * 5/2007 Funsten ..... H01J 49/025 250/281
2008/0061229 A1 * 3/2008 Burch ..... H01J 49/42 250/305

OTHER PUBLICATIONS

Allegrini, et al "Charge State of~1-50 keV Ions After Passing Through Graphene and Ultrathin Carbon Foils", Optical Engineering 53 (2), 024101-1 to 024101-6, Feb. 2014.
Desai, et al "An Integrated Time-of-Flight Versus Residual Energy Subsystem for a Compact Dual Ion Composition Experiment for Space Plasmas", Review of Scientific Instruments 86, 054501-1 to 054501-12 (2015).
Krimigis, et al "Magnetosphere Imaging Instrument (MIMI) on the Cassini Mission to Saturn/Titan" Space Science Reviews 114, pp. 233-329, 2004.
McComas, et al, "The Jovian Auroral Distributions experiment (JADE) on the Juno Mission to Jupiter", Space Science Review, published online w/open access at Springerlink.com <<http://link.springer.com/article/10.1007%2Fs11214-013-9990-9>>.
McComas et al, "The Solar Wind Around Pluto (SWAP) Instrument Aboard New Horizons", Space Science Reviews, Oct. 2008, vol. 140, Issue 1, pp. 261-313.
McNutt, et al "The Pluto Energetic Particle Spectrometer Science Investigation (PEPSSI) on the New Horizons Mission", Space Science Review, 2008, 140, pp. 315-385.

* cited by examiner

*Primary Examiner* — Wyatt Stoffa
*Assistant Examiner* — Eliza Osenbaugh-Stewart
(74) *Attorney, Agent, or Firm* — Tucker Grossman et al.

(57) ABSTRACT

A relatively compact dual ion composition instrument and associated methodology for measuring plasma and ion populations in a variety of interplanetary and planetary environments. The unitary device can measure mass and ionic charge state compositions and 3D velocity distributions of 10 eV/q to 40 keV/q plasma and pick-up ions; and (2) mass composition, energy spectra and angular distributions of 30 keV to 10 MeV energetic ions.

17 Claims, 2 Drawing Sheets

COMPACT DUAL ION COMPOSITION INSTRUMENT

FIELD

The present disclosure is directed at a relatively compact dual ion composition instrument, and associated methodology, for measuring plasma and ion populations in a variety of interplanetary and planetary environments. The unitary device can measure (1) mass and ionic charge state compositions and 3D velocity and angular distributions of 10 eV/q to 40 keV/q plasma and pick-up ions; and (2) mass composition, energy spectra and angular distributions of 30 keV to 10 MeV energetic ions.

BACKGROUND

Solar environments such as the solar atmosphere, interplanetary medium, and planetary magnetospheres evolve in time and space through the dynamic transfer of mass, momentum, and energy between the embedded electromagnetic fields and the constituent plasma and energetic particle populations. Thus, a complete characterization of plasma and particle environments covering the energy range of from a few eV up to tens of MeV is critical for many current and future Planetary and Heliophysics missions.

Presently, two or more instruments based on distinct measurement techniques are used to cover the large range in energies from thermal (~eV) to energetic (10 s of MeV) particles. Energetic particle instruments covering the energy range from tens of keV up to a few MeV use either solid state detectors (SSDs) to measure the residual energy (E') of the incoming particles, e.g., Cassini/Low-Energy Magnetospheric Measurement Systems-LEMMS, S. M. Krimigis et al, "Magnetosphere Imagining Instrument (MIMI) on the Cassini Mission to Saturn/Titan", Space Sci. Rev. 114, 233-329 (2004), or the Time-Of-Flight (TOF, $\tau$) vs. Residual Energy (E') measurements in SSDs, e.g., PEPSSI on New Horizons, J. R. L. McNutt et al, "*The Pluto Energetic Particle Spectrometer Science Investigation (PEPSSI) on the New Horizons Mission*", Space Sci. Rev. 140, 3150385 (2007). Occasionally, instruments such as the Charge-Energy-Mass-Spectrophotometer (CHEMS) on Cassini use electrostatic analyzers (ESAs) to perform energy-per-charge (E/q) analysis followed by TOF vs. E' of suprathermal ions. In contrast, plasma populations from a few eV to up to tens of keV are typically measured using simple ESAs that select ions in a narrow E/q range (e.g., *New Horizons/Solar Wind Around Pluto*-D. McComas et al, Space Sci Rev. 140, 261-313 (2008) then focus them onto electron multiplier detectors such as microchannel plates (MCPs) or channel electron multipliers (CEMs) or use an ESA followed by TOF measurements that provide the speed of the incoming particles (e.g. D. J. McComas et al, "*The Jovian Auroral Distributions Experiment (JADE) on the Juno Mission to Jupiter*" Space Sci. Rev. (published online).

The allocation of resources required by two or three separate instruments for obtaining complete information about energy, arrival direction, ionic charge state, and mass of individual ions often involves trade-offs and compromises that typically result in significant gaps in the energy coverage or even a complete lack of information about the ion's ionic charge state or mass. As a result, many key properties of ion populations and dynamics in a wide variety of space environments such as the interplanetary medium, the Earth's magnetosphere, and the magnetospheres of the outer planets are not fully explored.

SUMMARY

A dual ion composition instrument for measuring plasma and ion populations comprising a deflector/electrostatic analyzer subsystem and a time of flight versus energy subsystem wherein the deflector/electrostatic analyzer includes deflectors to bend a first collection of ions between greater than 1 eV/q to 100 keV/q into an electrostatic analyzer which focuses said ions onto carbon foil and wherein the carbon foil is positioned at an entrance of the time of flight versus energy subsystem. The first collection of ions contact the carbon foil and generate secondary electrons and neutralized ions from the first collection of ions. Entrance apertures are provided in the deflector/electrostatic analyzer subsystem for introduction of a second collection of ions between 15 keV to 10 MeV/nucleon which contact the carbon foil and generate secondary electrons and ions from the second collection of ions. A start micro-channel plate is positioned in the deflector analyzer subsystem which detects the secondary electrons from the first and second collection of ions. One or more avalanche photodiodes positioned in the time of flight versus energy subsystem generate additional secondary electrons due to an impact of the neutralized ions from the first collection of ions. One or more solid state detectors are positioned in said time of flight versus energy subsystem which generate additional secondary electrons due to an impact of said ions from the second collection of ions. A stop micro-channel plate is positioned in the time of flight versus energy subsystem, wherein the stop micro-channel plate detects additional secondary electrons due to impact of the ions from both of the first and second collection of ions.

BRIEF DESCRIPTION OF THE DRAWINGS

The above mentioned and other features of this disclosure, and the manner of attaining them, will become more apparent and better understood by reference to the following description of embodiments described herein taken in conjunction with the accompanying drawings wherein.

DETAILED DESCRIPTION

Figure 1:
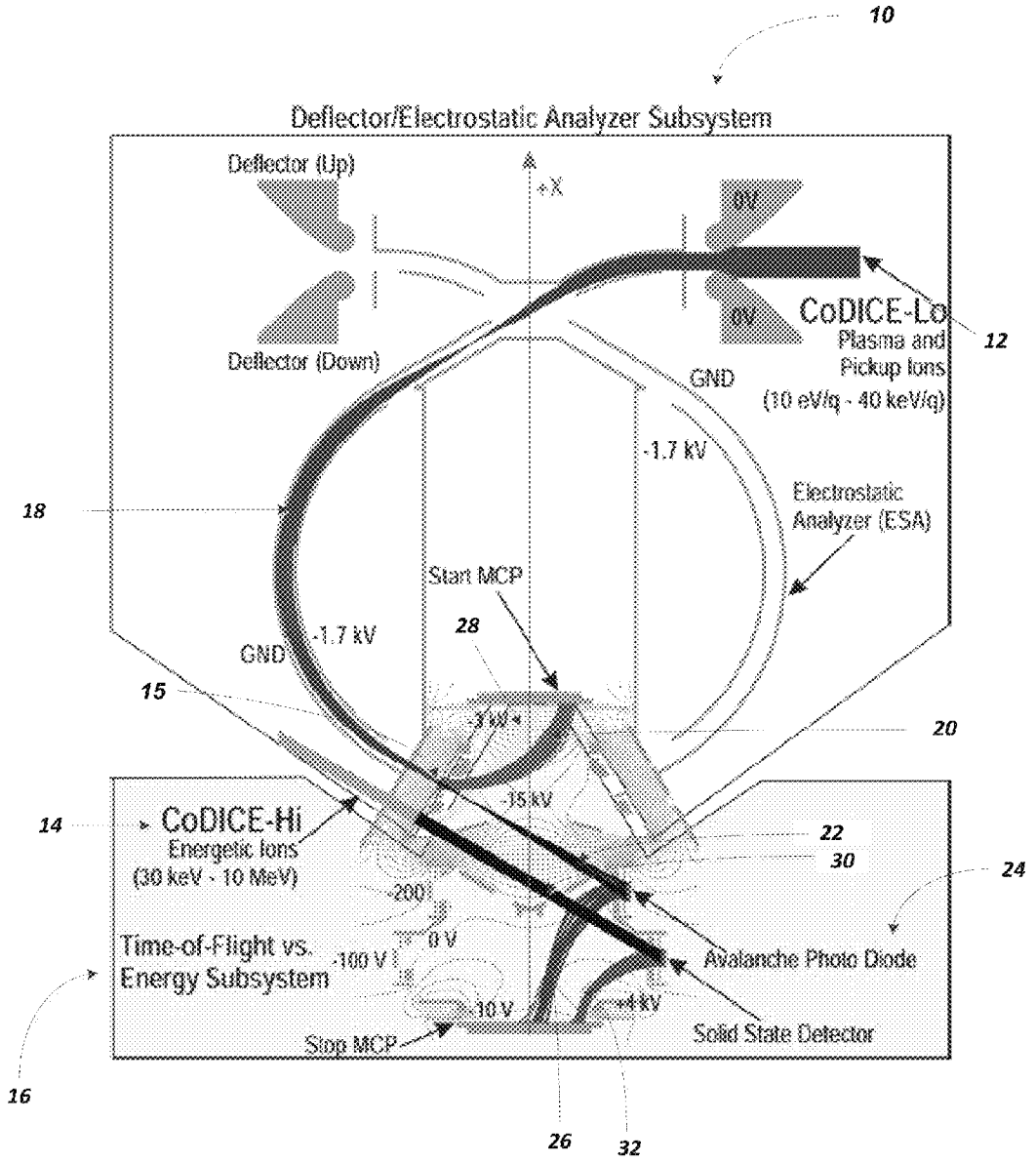
FIG. 1 illustrates a compact dual ion composition instrument.

The compact dual ion composition instrument 10 is illustrated in FIG. 1. As can be seen, the instrument 10 includes a deflector/electrostatic analyzer subsystem and a time of flight (TOF) versus energy subsystem, which identifies a preferred right-handed instrument coordinate system where +X-axis points along the symmetry axis of both the electrostatic analyzer (ESA) and the time of flight (TOF) vs. residual energy (E) subsystems and +Z is out of the page and +Y completes the right-handed system. The elevation angle $\theta$ (not shown) is the angle measured from the YZ plane toward the +X axis and the azimuthal angle $\phi$ is measured in a clockwise sense in the YZ plane. CoDICE-Lo (12) refers to a compact dual ion composition experiment within the device 10 that introduces plasma and pickup ions between greater than 1 eV/q to 100 keV/q, more preferably 10 eV/q to 40 keV/q. CoDICE-Hi (14) refers to a compact dual ion composition experiment within the device 10 that introduces energetic ions at 15 keV to 10 MeV/nucleon, more preferably 30 keV to 10 MeV.

Accordingly, plasma ions between ~10 eV/q and 40 keV/q with θ preferably within ±45° are selected using a combination of opposite voltage settings on the indicated Up and Down deflectors and logarithmically-spaced voltage steps on the ESA. The deflectors bend the ion trajectories into the ESA which focuses those with the appropriate E/q onto a relatively thin carbon foil 15 located at the entrance of the TOF vs. E subsystem identified generally at 16. Using deflectors to bend ion trajectories into the ESA enables CoDICE-Lo, on a three axis-stabilized spacecraft, to measure angular distributions and provide 3-dimensional velocity distribution functions (3D VDFs) of plasma ions over a broad range of energies and angles.

The ESA selected plasma ions generate secondary electrons off of a thin carbon foil at the entrance aperture of the TOF vs. E subsystem. Both the entrance foil and the TOF start assembly section will be biased to −15 kV bias which accelerates the ions entering the subsystem by 15 keV/q (FIG. 1: curves 18 in the ESA). The distance between the −15 kV electrodes and grounded electrodes is ≥8.25 mm, which yields an electric field of ≤1.8 kV/mm. It is contemplated that the bias on the Start TOF/foil section can be increased up to ≅20 kV or ~2.5 kV/mm.

The secondary electrons (FIG. 1: curves 20) are deflected upwards as shown onto outer annulus of the start microchannel plate (Start MCP) and an annular 24-discrete anode configuration at the outer edge. This provides the start TOF signal for CoDICE-Lo (Lo-Start) and the azimuth of the ion. It is worth noting that other configurations, e.g. a delay-line anode, may be employed to provide the same measurements. A micro-channel plate (MCP) is reference to a generally planar component used for detection of particles (electrons or ions) and impinging radiation (ultraviolet radiation and X-rays). It is closely related to an electron multiplier, as both intensify single particles or photons by the multiplication of electrons via secondary emission.

The mostly neutralized ions shown at line 22 preferably travel ~5.9 cm along a straight, collimated path and depending on which azimuthal angle it entered the ESA at and strike one or more avalanche photo diodes (APDs) shown at 24 and generate secondary electrons (curves 26) that are focused onto the center of the stop microchannel plate (Stop MCP) which in this case provides the Lo-Stop event. Reference to a mostly neutralized ion may be understood by the feature that there is an energy-dependence in the fraction of neutralized ions. At ~20 keV, ~65% of H+ ions passing through the carbon foil are neutralized. This fraction is larger for the lower (<20 keV H+) ions. Likewise, at 20 keV, ~90% of He+, O+, C+, Ar+ ions are neutralized.

An avalanche photodiode (APD) is understood herein as a relatively sensitive semiconductor electronic device that exploits the photoelectric effect to convert light to electricity and amount to photodetectors that provide a built-in first stage of gain through avalanche multiplication. The distance of travel of the mostly neutralized ions along line 22 may fall in the range of 5.9±0.12 cm. Each APD measures the ion's residual energy (E) and its location provides the ion's arrival direction. Each APD is preferably ~150 μm thick with a 3×5 $mm^2$ active area.

The time between Lo-Start and Lo-Stop yields the ion's TOF, and hence speed (v). The E/q selection, combined with v and E, determines the mass (M), incident energy, and charge state (q) of plasma ions, allowing for identification of ions with the same M/q (e.g., $S^{2+}$ and $O^{+}$) in all look directions. The ion mass is determined by $M=2(\tau/d)^2$ (E'/a), where τ is the TOF, d is the path length (5.9 cm), E' is the measured residual energy, and a is the ratio between E' and the incident ion energy. The incident energy E is determined by E=E'/a−qV, with the charge state q determined by E/(E/q). For example, when one measures 1 keV singly charged oxygen ions, a set of measured values will be: E/q=1 keV, τ=139 ns, E'=5.4 keV where the term a is determined as 0.34 from the calibration table, and one can determine E, M, and q simultaneously: E=0.99 keV; M=16.89 AMU; q=0.99.

The CoDICE-Hi TOF preferably begins with a separate set of 12 entrance apertures for detecting, in preferred embodiment, ~0.03-10 MeV ions (FIG. 1, item 14). Incident ions preferably pass through a 70-nm-thick aluminum-polyimide sandwich foil placed near the entrance of a "honeycomb like" collimator that is located outside each CoDICE-Hi entrance aperture. The foil blocks UV light and stops protons up to ~5 keV from entering the collimator and TOF vs. E subsystem, and therefore, from contaminating the CoDICE-Hi TOF signals. Angular scattering and energy losses through the thick foil reduce the geometric factor near the lower energy range of CoDICE-Hi. The collimators limit the CoDICE-Hi FOV to 5°×10° in elevation and azimuth.

Energetic ions (EIs) enter the TOF section after passing through a different thin carbon foil located at the start of the TOF entrance aperture and generate secondary electrons. These secondary electrons are focused onto the inner circular portion of the start MCP (FIG. 1: curve 28), providing the Hi-Start TOF signal. The energetic ions (EIs) travel a relatively longer (~7.4 cm) path 30 and strike one of a plurality of solid state detectors (SSDs), twelve being particularly preferred, distributed over 360° azimuth where they generate secondary electrons which are deflected onto the outer annulus of the stop MCP to provide the stop TOF signal shown at 32 (Hi-Stop). Path 30 may therefore define a distance that falls in the range of 7.4±0.13 cm. Accordingly, it can be appreciated that the distance from the carbon foil and the avalanche photo diodes is less than the distance from the carbon foil and the solid state detector. In addition, it is worth noting that most of the ions (e.g. greater than 50%) in CoDICE-Hi remain ionized after passing through the foil.

The difference between Hi-Start and Hi-Stop signals yields the ion's TOF, and hence the ion speed. The longer path length allows CoDICE-Hi to measure relatively shorter TOFs of the faster EIs more accurately, thereby extending the upper energy range for EI measurements. Each SSD is preferably ~500 μm thick with a 5×10 $mm^2$ active area. For each EI, CoDICE-Hi measures the speed (from TOF) and E' in the SSD to determine its M and incident energy E, and the location of the SSD provides the arrival direction of the ion.

By way of an exemplary calculation for the CoDICE-Hi, the ion mass is again determined by $M=2(\tau/d)^2$ (E'/a), where d is the path length (7.4 cm), τ is the TOF, and the ratio "a" between the incident energy E and measured residual energy E' is again as follows: E=E'/a−qV. One may then measure 450 keV oxygen ions, a set of measured values will be: τ=32 ns, E'=321 keV, and using a=0.69 from the calibration table, and we can determine E, M simultaneously. E=450.21 keV; M=16.67 AMU.

Working Example

The TOF instrument illustrated in FIG. 1 was biased at −10 kV which accelerates incident ions by 10 keV/q. To compare laboratory results with the electro-optic response of a TOF subsystem biased at −15 kV, a test was made of the instrument performance along with measurement of its intrinsic resolution using monoenergetic ion beams at 3 different energies: 6, 15, and 50 keV and 6 different species, namely, $H^+$, $He^+$, $O^+$, $N^+$, $Ne^+$, and $Ar^+$. Since all ion species are singly charged, the corresponding incident energies are equivalent to 1, 10, and 45 keV, respectively and the exit energies after the start foils are equivalent to 16, 25, and 60 keV, respectively. For simplicity, the incident ion energy was utilized to describe the results herein. For all TOF prototype tests, ~1 μg/cm$^2$ carbon foil was employed at the entrance of the CoDICE-Lo and CoDICE-Hi TOF vs. E subsystem. See again, FIG. 1.

Figure 2:
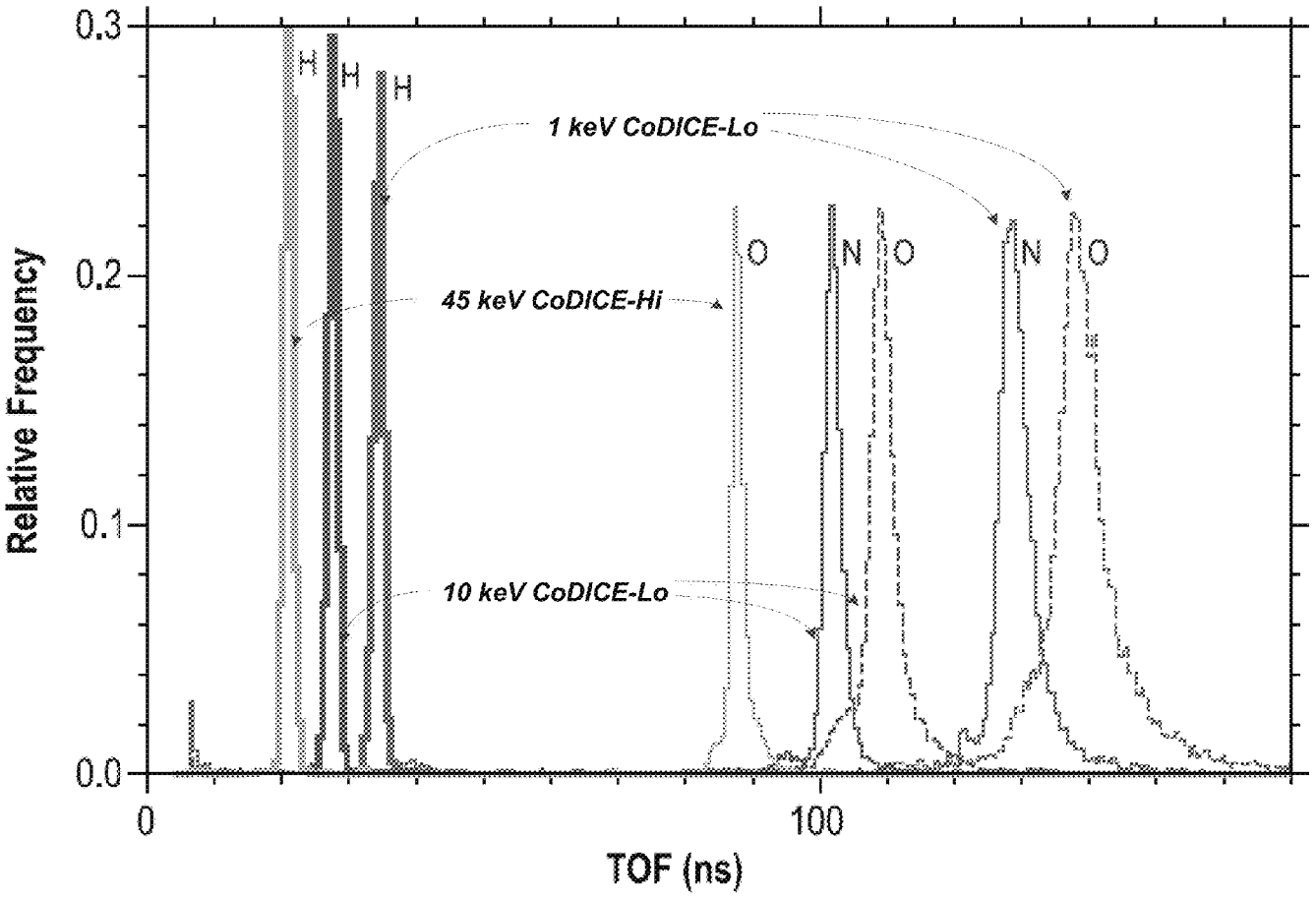
FIG. 2 shows time of flight distributions (relative frequency versus time of flight) for 1 & 10 keV $H^+$, $N^+$, and $O^+$ ions and 45 keV $H^+$ and $O^+$ ions, utilizing the apparatus of FIG. 1.

FIG. 2 shows TOF distributions for 1 & 10 keV $H^+$, $N^+$, and $O^+$ ions in CoDICE-Lo and 45 keV $H^+$ and $O^+$ ions in CoDICE-Hi. The TOF spectra show that CoDICE-Lo successfully identifies peaks corresponding to $H^+$, $N^+$ & $O^+$ ions, and also that neighboring species such as $N^+$ and $O^+$ are well separated. For CoDICE-Lo, the observed TOF dispersion for 1 keV $H^+$ is ~1.6 ns. The overall TOF resolution ($\Delta\tau/\tau$) ranges from ~3% to ~6% for all species and energies. For the higher energy ions in CoDICE-Hi, the TOF dispersion is significantly less than that measured by CoDICE-Lo for all ion species.

Accordingly, the present disclosure identifies a compact dual ion composition instrument and associated method which comprises a deflector/electrostatic analyzer and a common TOF vs. E subsystem for measuring plasma, pickup, and energetic ion populations in a variety of interplanetary and planetary environments. The instrument is designed to measure: (1) mass and ionic charge state compositions, and 3D velocity and angular distributions of ~10 eV/q-40 keV/q plasma and pickup ions; and (2) Mass composition, energy spectra, and angular distributions of ~30 keV-10 MeV energetic ions.

The instrument herein as illustrated in FIG. 1 is contemplated to have an overall mass of 2.0-4.0 kg and a length of 150 mm to 250 mm, a width of 150 mm to 250 mm and a height of 250 mm to 350 mm and may therefore replace at least two separate instruments that are typically flown on deep space missions. The instrument herein in either the CoDICE-Lo or CoDICE Hi configuration is capable of measuring mass and ionic charge states of all species from H—Fe. However, the ions that are more typically evaluated include $H^+$, $He^+$, $O^+$, $N^+$, $Ne^+$, or $Ar^+$.

While the instrumentation herein is contemplated to be suitable, e.g., for Jupiter's magnetosphere and possibly for other high radiation environments, the instrumentation is contemplated to also provide high quality plasma and energetic ion composition measurements on missions to Mercury, Venus, Mars, Neptune, and Uranus, as well as on in-situ inner and outer heliospheric missions.

The invention claimed is:

1. A dual ion composition instrument for measuring plasma and ion populations comprising:

a. a deflector/electrostatic analyzer subsystem and a time of flight versus energy subsystem wherein said deflector/electrostatic analyzer includes deflectors to bend a first collection of ions between greater than 1 eV/q to 100 keV/q into an electrostatic analyzer which focuses said ions onto carbon foil and wherein said carbon foil is positioned at an entrance of said time of flight versus energy subsystem and wherein said first collection of ions contact said carbon foil and generate secondary electrons and neutralized ions from said first collection of ions;

b. entrance apertures in said deflector/electrostatic analyzer subsystem for introduction of a second collection of ions between 15 keV to 10 MeV/nucleon which contact said carbon foil and generate secondary electrons and ions from said second collection of ions;

c. a start micro-channel plate in said deflector analyzer subsystem which detects said secondary electrons from said first and second collection of ions;

d. one or more avalanche photo diodes in said time of flight versus energy subsystem which generates additional secondary electrons due to an impact of said neutralized ions from said first collection of ions;

e. one or more solid state detectors in said time of flight versus energy subsystem which generate additional secondary electrons due to an impact of said ions from said second collection of ions; and f. a stop micro-channel plate in said time of flight versus energy subsystem, wherein said stop micro-channel plate detects additional secondary electrons due to impact of said ions from both of said first and second collection of ions.

2. The dual ion composition instrument of claim 1 wherein said first collection of ions are at 10 eV/q to 40 keV/q.

3. The dual ion composition instrument of claim 1 wherein said second collection of ions are at 30 keV to 10 MeV.

4. The dual ion composition instrument of claim 1 wherein said instrument has a mass of 2.0 kg to 4.0 kg.

5. The dual ion composition instrument of claim 1 wherein said instrument has a length of 150 mm to 250 mm, a width of 150 mm to 250 mm and a height of 250 mm to 350 mm.

6. The dual ion composition instrument of claim 1 wherein a distance from said carbon foil and said one or more avalanche photo diodes is less than the distance from said carbon foil and said solid state detector.

7. The dual ion composition instrument of claim 1 wherein said first collection of ions comprises $H^+$, $He^+$, $O^+$, $N^+$, $Ne^+$, or $Ar^+$.

8. The dual ion composition instrument of claim 1 wherein said second collection of ions comprises $H^+$, $He^+$, $O^+$, $N^+$, $Ne^+$, or $Ar^+$.

9. A method for measuring plasma and ion populations comprising:

a. supplying a dual ion composition instrument including a dual ion deflector/electrostatic analyzer subsystem and a time of flight versus energy subsystem wherein said deflector/electrostatic analyzer includes:

i. deflectors to bend a first collection of ions between greater than 1 eV/q to 100 keV/q into an electrostatic analyzer which focuses said ions onto carbon foil and wherein said carbon foil is positioned at an entrance of said time of flight versus energy subsystem and wherein said first collection of ions contact said carbon foil and generate secondary electrons and neutralized ions from said first collection of ions;

ii. entrance apertures in said deflector/electrostatic analyzer subsystem for introduction of a second collection of ions between 15 keV to 10 MeV which contact said carbon foil and generate secondary electrons and ions from said second collection of ions;

iii. a start micro-channel plate in said deflector analyzer subsystem which detects said secondary electrons from said first and second collection of ions;

iv. said time of flight versus energy subsystem including 1. one or more avalanche photo diodes which generates additional secondary electrons due to an impact of said neutralized ions from said first collection of ions;
2. one or more solid state detectors in said time of flight versus energy subsystem which generate additional secondary electrons due to an impact of said ions from said second collection of ions; and
3. a stop micro-channel plate in said time of flight versus energy subsystem, wherein said stop micro-channel plate detects additional secondary electrons due to impact of said ions from both of said first and second collection of ions;

b. identifying a start time of flight signal for said first collection of ions when said secondary electrons from said first collection of ions contact said start micro-channel plate in said deflector analyzer subsystem;

c. identifying a start time of flight signal for said second collection of ions when said secondary electrons from said second collection of ions contact said start micro-channel plate in said deflector analyzer subsystem;

d. identifying a stop time of flight signal for said first collection of ions when said additional secondary electrons from said impact of said neutralized ions with said avalanche photo diode impact said stop micro-channel plate in said time of flight versus energy subsystem;

e. identifying a stop time of flight signal for said second collection of ions when said additional secondary electrons from said impact of said ions with said solid state detector impact said stop micro-channel plate in said time of flight versus energy subsystem.

10. The method of claim 9 wherein the difference in time between said start time of flight signal and said stop time of flight signal for said first collection of ions identifies ion speed.

11. The method of claim 9 wherein the difference in time between said start time of flight signal and said stop time of flight signal for said second collection of ions identifies ion speed.

12. The method of claim 9 wherein said instrument has a mass of 2.0 kg to 4.0 kg.

13. The method of claim 9 wherein said instrument has a length of 150 mm to 250 mm, a width of 250 mm to 250 mm and a height of 250 mm to 350 mm.

14. The method of claim 9 wherein said first collection of ions comprises $H^+$, $He^+$, $O^+$, $N^+$, $Ne^+$, or $Ar^+$.

15. The method of claim 9 wherein said second collection of ions comprises $H^+$, $He^+$, $O^+$, $N^+$, $Ne^+$, or $Ar^+$.

16. The method of claim 9 wherein said first collection of ions are at 10 eV/q to 40 keV/q.

17. The method of claim 9 wherein said second collection of ions are at 30 keV to 10 MeV.

* * * * *